United States Patent [19]

Hirayama et al.

[11] 4,076,177

[45] Feb. 28, 1978

[54] PULVERIZING METHOD AND APPARATUS

[75] Inventors: Yoshio Hirayama, Zushi; Kanichi Ito, Yokohama; Ryoichi Takeuchi, Kamakura; Masao Nomoto, Tokyo; Tomoyuki Shiina, Yokohama, all of Japan

[73] Assignee: Agency of Industrial Science & Technology, Tokyo, Japan

[21] Appl. No.: 697,734

[22] Filed: Jun. 18, 1976

[30] Foreign Application Priority Data

| | | |
|---|---|---|
| Jun. 24, 1975 | Japan | 50-77981 |
| Feb. 17, 1976 | Japan | 51-16099 |

[51] Int. Cl.[2] ..... B02C 23/04

[52] U.S. Cl. ..... 241/32; 241/73; 241/87; 241/DIG. 38

[58] Field of Search ..... 241/14, 20, 21, 24, 241/27, 30, 32, 45, 73, 86, 87, 163, DIG. 38

[56] References Cited

U.S. PATENT DOCUMENTS

| | | | |
|---|---|---|---|
| 1,761,083 | 6/1930 | Liggett | 241/32 |
| 2,846,153 | 8/1958 | Krogh | 241/86 |
| 3,061,205 | 10/1962 | Lavallee | 241/DIG. 38 |
| 3,973,735 | 8/1976 | Ito et al. | 241/DIG. 38 |

*Primary Examiner*—Granville Y. Custer, Jr.
*Attorney, Agent, or Firm*—Wenderoth, Lind & Ponack

[57] ABSTRACT

A method and apparatus for use in pulverization and/or segregation which is suitable for obtaining the desired quality of the pulverized materials. Such pulverization is performed by restricting the discharge rate of the mixture through the discharge opening and thereby controlling the quantity and time the mixture remains within the pulverizer. The pulverizer is provided with a weir at the discharge end of the drum or cylinder for such restricting purpose. Also, beaters disposed within the pulverizer are provided with safety means enabling the beaters to pivot when a relatively stiff constituent is encountered in the mixture.

7 Claims, 22 Drawing Figures

STAYING TIME OF WASTE WITHIN PULVERIZER RELATIVE TO HEIGHT OF WEIR

PULVERIZER: SAME AS NOTED IN FIG. 6 EXCEPT FOR ROTATIONAL SPEED OF BEATERS

STAYING TIME "T" RELATIVE TO BEATER ROTATION

PULVERIZING METHOD AND APPARATUS

CROSS-REFERENCE TO RELATED APPLICATIONS

Reference is made to U.S. Patent Application Ser. No. 561,651 entitled "Apparatus for Pulverizing and Sorting Municipal Waste" filed on Mar. 24, 1975 in the names of Kanichi Ito et al, now U.S. Pat. No. 3,973,735.

FIELD OF THE INVENTION

The present invention is related to a method and apparatus for pulverizing and/or sorting an object mixture which contains several constituents and more particularly to such method and apparatus employing a drum type device having improved efficiency.

BACKGROUND OF INVENTION

A typical example of the mixture is municipal waste. Such municipal waste is generally composed of different kinds of waste such as garbage (food waste), wastepaper, wood chips, wastefiber (cloth), plastics, glass, metal chips or the like and these constituents are randomly mixed in the municipal waste which is collected. The respective constituents are of different physicial properties and, therefore, it is relatively difficult to sort and recover specific kinds for re-utilization. Further, it is also generally required to apply some pre-treatment processes to the municipal waste so as to perform sorting efficiently. The pre-treatment may be pulverization by a pulverizer to reduce and segregate the different constituents to a single constituent, respectively and to make the size of the pulverized constituents substantially uniform in size. However, it is difficult for the pulverizer of the prior art to uniformly and effectively pulverize the municipal waste comprising several constituents. Further, the prior art pulverizers consume much power and their elements are subjected to relatively rapid wear. Thus, a process utilizing this prior art pulverizer requires high operating and maintenance costs and is not satisfactory from an economic view point.

Thus, a method and apparatus have been developed to obviate the drawbacks above by paying particular attention to the difference in physical properties between the constituents of the object mixture to be treated. That is, the development was aimed at positively utilizing such characteristic differences and this resulted in a different pulverization time for each of the constituents to be pulverized to obtain particles or pieces of a certain uniform size. Consideration of such time difference leads to construction of a drum-type pulverizer and to feeding the constituents axially therethrough so that the pulverized constituents could be discharged at different axial positions depending on the progress of pulverization which, to a certain degree, is a function of elapsed time.

Thus, it is recognized from the above, that controlling the residence or staying time and axial advancement of the object mixture in a drum type apparatus is one of the important factors in this invention.

Also, some parts of the prior art pulverizers, such as beaters, are often damaged by relatively stiff constituents contained in the mixture which might result in shut-down of the operation and/or damage to the apparatus. Therefore it has been also desired to provide an apparatus which is free from such disadvantages.

Further, the prior art apparatus is relatively large and long. As a result, in the main shaft, which normally carries a plurality of elements such as beaters and/or anti-entangling plates, sometimes deflects due to its weight. If such deflection occurs, it may be difficult to maintain proper gaps between the tips of the beaters and the inner surface of the drum or the elements mounted on the inner side of the drum. One way to overcome the problem of deflection is to make the shaft more rigid, but this results in an increase of weight. It is preferable to increase the stiffness of the shaft without a remarkable increase in the weight and without reducing efficiency.

SUMMARY OF INVENTION

Accordingly, it is an object of the invention to provide an improved method and apparatus which are suitable for pulverizing and/or sorting an object mixture comprising several kinds of constituents with greater efficiency.

It is another object of the invention to provide a method and apparatus capable of controlling residence or staying time of the object mixture to be treated in a drum type apparatus.

It is a further object of the present invention to provide means for stiffening the main shaft of the apparatus referred to above without remarkably increasing the weight of the apparatus and also without decreasing the efficiency of the apparatus.

A further object of the present invention is to provide an apparatus as discussed above which is easy and economical to manufacture, install and maintain.

It is also an object of the present invention to provide means for overcoming the problem which might be caused by relatively stiff constituents in the mixture to prevent the apparatus from being damaged.

According to the present invention, the objects above as well as other objects not specifically touched upon are attained.

The apparatus constructed according to the present invention comprises an inlet section, pulverizing section and an outlet section. A central shaft extends through these sections and a plurality of beaters and anti-entangling plates are radially mounted on this shaft. In the pulverizing section, a cylindrical screen is rotatably mounted and on the inner surface of the screen, a plurality of ridge projections are disposed so as to oppose the tips of the beaters. A suitable driving means is provided to produce relative rotation between the beaters and the cylindrical screen. The cylindrical screen and the shaft may be divided into two parts, respectively, so as to be driven independently and provide versatility in operation. Also in some of the embodiments, beaters may be mounted pivotably, but are normally held non-pivotable by additional shear pins which may be sheared when the beaters encounter relatively stiff constituents so that the damage of the elements of the apparatus may be prevented by the limited shear of the shearing pins. One of the most distinguishing features of the present invention is a weir provided at the outlet opening of the cylindrical screen to restrict the discharge rate of the object mixture therethrough and control the residence or staying time of the object mixture within the pulverizer, as well as the quantity of the object mixture in the pulverizer. The degree of the restriction may be variable.

Also, if the shaft is large, there is a spider assembly at the intermediate position between the opposite ends of the shaft, where the shaft is normally divided, to prevent the shaft from deflecting due to the increased weight of the shaft and elements associated therewith.

The objects and advantages of the present invention will be further clarified by the explanation following the brief description of the accompanying drawings noted below.

BRIEF DESCRIPTION OF DRAWINGS

Reference is made to the drawings wherein.

DETAILED DESCRIPTION OF PREFERRED EMBODIMENTS

Figures 1, 2, 3, 4:
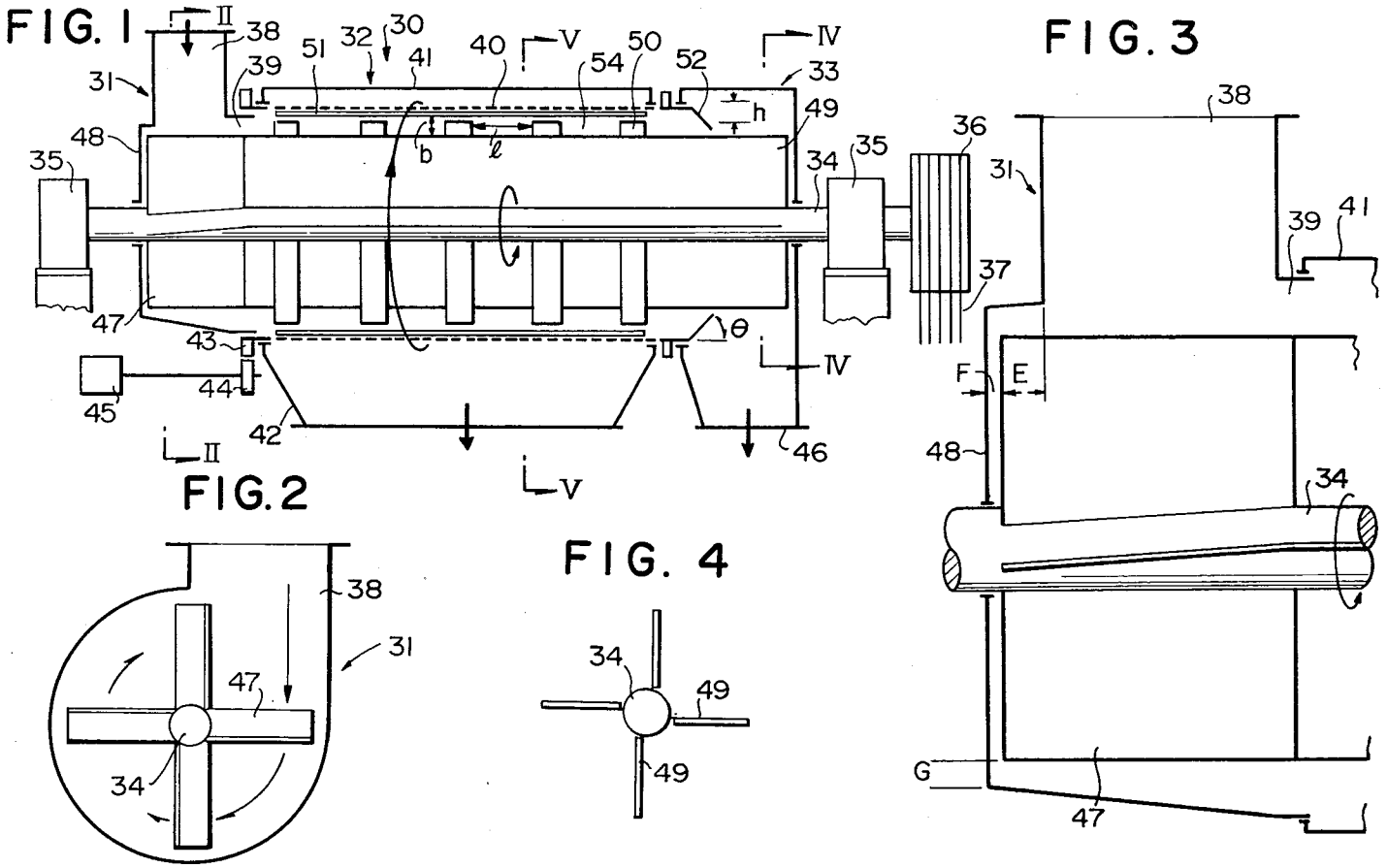
FIG. 1 is a schematic illustration of a preferred embodiment according to the present invention.
FIG. 2 is a cross-section of the pulverizer illustrated in FIG. 1 taken along line II—II.
FIG. 3 is a fragmental enlarged view of a portion of the pulverizer of FIG. 1.
FIG. 4 is a cross-section of the pulverizer of FIG. 1 taken along line IV—IV.

Although the method and apparatus of the present invention are applicable to various purposes such as pulverizing and/or sorting municipal waste, rotatably sieving gravel, cereals or the like, for use in fermentation drying processes, etc., for convenience, the description herein will be made with reference to an operation for pulverizing and sorting municipal waste. It is noted, however, that, the description of this example is not intended to limit the scope of the present invention.

In the foregoing paragraphs, we have discussed one of the important factors, namely control of the residence or staying time of the mixture in the apparatus. The requirements for such control may be summarized as below.

a. The mixture is to be fed or advanced in a pulverizer while maintaining a desired residence of staying time within the pulverizer;

b. The mechanism of the pulverizer is readily modified when a change in the staying time of the mixture within the pulverizer is desired; and c. Capacity of the apparatus for pulverizing and sorting may not be affected by provision of such control facility.

In a drum type pulverizing mechanism including a cylindrical screen, feeding or advancement of the mixture within the drum may be performed in several steps such as 1. mounting the drum with canting of the axis thereof;
2. providing twist or inclination to the beating elements mounted on the central shaft so that the rotation of the shaft advances the mixture received in the drum;
3. providing projections on the inside surface of the drum which are inclined or in spiral with respect to the axis of the drum so that rotation of the drum effects such advancement; and
4. controlling the discharge rate of the mixture by providing a proper means at the discharge outlet of the apparatus.

The inventors investigated the several steps above and reached the following observations. Step #1 may be the generally accepted way; however, it is relatively complicated in design and it is relatively difficult to manufacture and install and to provide inclination to the axis of a pulverizer which is relatively heavy, say weighing several scores of tons or more. Rather, for ease of maintenance it is preferable to make such axis horizontal. The step #2 above also has drawbacks from the manufacturing standpoint since such provision makes the fabrication and assembly thereof complex. Further, the constituents of the municipal waste and their respective ratio relative to the whole mixture may vary from place to place and from season to season. Therefore, to accommodate such variation of the constituents while keeping the desired capability, it may be considered to adjust the rotational speed either of the drum or the shaft with beaters or both depending on the kinds and proportions of the constituents. However, if the speed is changed or adjusted for the method and apparatus incorporating the step #2, the residence or staying time of the mixture will be affected by such adjustment and, thus, proper adjustment for this types has been difficult. Also, in the apparatus incorporating step #3 may have drawbacks similar to that incorporating step #2; however, the effect of the inclination of the ridge projections alone may not be so effective in advancing effect as that incorporating step #2 or the combination of step #2 and step #3. Thus, it should be understood that employment of the inclination of the ridge projections may not be objected to in the present invention. Also, the inclination may be applied to the ridge projections partially in the axial direction of the drum such as where enhancement of shearing effect is desired.

The inventors of the present invention, thus conceived and developed step #4. Referring now to FIG.

1, there is illustrated a preferred embodiment of an apparatus which discloses the basic unit of the present invention. In FIG. 1, a pulverizer is generally designated by reference 30. This is of course a drum type pulverizer and consists mainly of three sections or zones, namely an inlet section 31, a pulverizing section 32, and an outlet section 33 which is axially opposite to the inlet section 31. These three sections are disposed sequentially so that the municipal waste is advanced from the left to right in FIG. 1. There is provided a main shaft 34 which extends through the three sections and at the opposite ends both outside of the three sections, there are suitable bearings 35 adapted to rotatably support the shaft 34. One end of the shaft further extends so as to mount a pulley 36 which receives rotating power through belts 37 or the like.

Returning again to the primary sections 31, 32 and 33, the inlet section 31 is stationary and provided with a hopper 38, adapted to receive the municipal waste thereinto, and an opening 39 communicating with the pulverizing section 32. The pulverizing section 32 comprises two major components, a cylindrical screen 40 provided with a plurality of perforations on the surface thereof, and an outer casing 41 surrounding the cylindrical screen 40. The cylindrical screen 40 is rotatably supported by a suitable means (an example thereof may be explained later in connection with FIGS. 9 and 10) and is coaxial with the main shaft 34. The outer casing 41 is stationary relative to the cylindrical screen and is provided with a discharge port 42. One end of the cylindrical screen is arranged to maintain communication with the opening 39 during the rotation of the screen 40. The screen 40 is preferably provided with a driving means such as a ring gear 43 adapted to mesh with a pinion 44 which is driven by a power source such as an electric motor 45. The outlet section 33 is also stationary and is adapted to receive the portion of the municipal waste which has not discharged through the discharge port 42 and finally to discharge such portion through an exhaust port 46.

Within the inlet section 31, feeding blades 47 are radially mounted on the shaft 34 in such a manner that, upon rotation of the shaft 34, the municipal waste received in the inlet section is advanced or urged into the cylindrical screen 40 by, for example, giving inclination or twist to the blades 47 with respect to the axis of the shaft 34. FIG. 2 illustrates the sectional configuration of the inlet section 31 taken through the line II—II in FIG. 1. As shown in this drawing, the inlet section is constructed with the feed hopper 38 located to one side of shaft 34 so that the materials fed through the hopper 38 fall on the blades 47 and follow a somewhat spiral path through the inlet section. Also the portion of the inlet section axially opposite to the opening 39 is extended to the left in FIG. 1 beyond the lower end of the hopper 38 so as to encase the extended portions (to be explained below) of the feeding blades 47 by a casing portion 48. The extended portions of the feeding blades 47 also axially extend beyond the region corresponding to the lower end of the hopper 38 as indicated by dimension "E" in FIG. 3 with clearance "F" relative to the casing portion 48. Also, the casing portion 48 is constructed so as to provide minimum clearance "G" at the left end of the feeding blades 47 in FIG. 3 between the portion 48 and the outer tips of the blades 47 this clearance is gradually increased in the direction toward the pulverizing section 32 as schematically illustrated in FIG. 3. The dimension "E" is to be determined by taking into consideration the possibility that the waste may reach the portion of the shaft 34 corresponding to "F" so that the waste entangles on that portion of the shaft or is caught between the blades 47 and the casing 48, thereby causing obstruction in the operation of the pulverizer, especially in the case when the dimension of "E" is negligible. Therefore, the dimension of "E" is made long enough to prevent the waste from reaching the portion F; otherwise such waste might be directed in the direction opposite to the exhaust port 46 upon being charged through the hopper 38 and cause a disturbance in the operation of the pulverizer. By the consideration on the "E" and "G" as above, the waste occasionally fed toward the left as viewed in FIG. 1 or FIG. 3 is effectively fed in the normal direction, i.e. to the right by the effect of the blades 47 and possible drawbacks that otherwise might occur such as increased power consumption or vibration are eliminated.

Although the feeding blades 47 are illustrated as mounted on the shaft 34, they may be alternatively coupled with the rotatable cylindrical screen 40 for the purpose of rotation.

Figure 5:
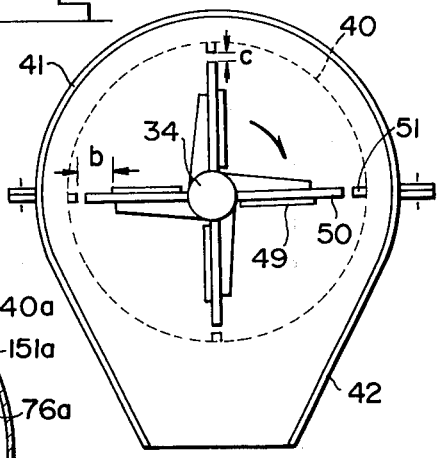
FIG. 5 is also a cross-section of the pulverizer of FIG. 1 taken along line V—V.

Within the cylindrical screen 40 and the outlet section 33, a plurality of anti-entangling plates 49 are mounted on the shaft 34. In the preferred embodiment illustrated, four plates 49 are radially mounted as illustrated in FIG. 1 and FIG. 4. Also, within the region of the cylindrical screen 40, there are a plurality of beaters 50 mounted on the main shaft 34, the manner of which is illustrated in FIG. 1 and FIG. 5. The beaters 50 are also preferably radially mounted in combination with the anti-entangling plates 49.

The anti-entangling plates also serve to beat and agitate the waste; however, as seen in FIG. 4, by providing the anti-entangling plates, the shaft and/or the sleeve couplings and distance pieces, etc. normally employed in the rotatable shaft are not exposed in a complete cylindrical configuration and, thus, the elongated constituents of which tend to become entangled with or on the rotating elements are effectively prevented from winding around the shaft.

As also shown in FIG. 5, a plurality of ridge projections 51 are axially mounted on the inner surface of the cylindrical screen with a clearance from the tips of the beaters 50 so as not to interfere with the beaters upon rotation of the shaft 34 and the screen 40. However, the ridge projections 51 may be given an inclination as already touched upon in the explanation with respect to step #3. The provision of ridge projections 51 enhances the pulverizing effect caused by the rotation of the beaters 50 and the cylindrical screen 40.

The clearance "*c*" betweem the tips of the beaters 50 and the ridge projections is preferably determined taking into consideration the physical properties of the municipal waste and what constituents are to be recovered.

Generally, the dimension of "*c*" is preferably less than the equivalent diameter "*d*" of the perforations in the cylindrical screen. The term "equivalent diameter" is employed herein to designate a diameter of a circle whose area is equivalent to the area of each perforation whatever shape it may be. As for example, if it is desired to recover waste paper from municipal waste as crude pulp stock, the following relationship is preferred.

$$c < 0.7d$$

Usually and preferably, the value of "*d*" is 20 – 45 mm.

As seen in FIGS. 1 and 5, the anti-entangling plates 49 are arranged to be smaller in diameter than the beaters so that passages 54 are defined by the opposing edges of adjacent beaters 50, the edge of the plates 49 and the inside surface of the screen 40 or the inside edge of the projections 51. These passages 54 allow passage therethrough of the constituents, such as metals and materials having high tenacity, which would not be pulverized by the beaters, screens and the ridge projections. The dimensions "*l*" and "*b*" relating to the passages were found to be practical if chosen within the following ranges.

$$b = 100 - 400 \text{ mm}$$

$$l = 100 - 400 \text{ mm}$$

Returning to FIG. 1 again, a weir 52 is provided at the discharge side opening of the cylindrical screen 40. The weir 52 is partially cylindrical and partially frusto-conical, and the smallest diameter portion of the frusto-conical portion is opened to communicate with the outlet section 33. Inclination of the frusto-conical surface with respect to the axis of the shaft is indicated as "$\theta$" which is preferably in the range of20° – 40°; however, it is not limited to this range. This weir 52 may be constructed in two shells and is easily attached to the cylindrical screen 40. This weir 52 is one of the modes developed in line with step #4 discussed in the beginning of this section of th specification. That is, the weir is adapted to control the residence or staying time in the pulverizer by restricting the rate of discharge of the municipal waste at the opening thereof by the frusto-conical portion. The dimension of the frusto-conical portion designated as "*h*" in FIG. 1 will be referred to as the "height" of the weir 52. This dimension "*h*" is measured in the direction perpendicular to the axis of the frusto-conical portion. The height or inclination or both are the factors for controlling the staying time of the mixture of municipal waste within the pulverizer. Thus, it is also preferable to make the weir 52 interchangeable, each one having different dimensions. These factors will be discussed again later.

The operation of the pulverizer 30 will be touched upon before proceeding further with the explanation. The municipal waste is charged into the hopper 38 and the feeding blades 47 advance and urge the received waste in the casting portion 48 into the cylindrical screen 40. Since the respective driving sources for the main shaft 34 and the cylindrical screen 40 are different, the rotation of the screen and the shaft may be optionally determined depending on the constituents of the waste or other factors such as what constituents are desired to be recovered. In other words, the screen and the shaft may be rotated at the same angular velocity, at different velocities either in the same direction or opposite directions, or either one of them may be kept stationary. The rotational speed of the cylindrical screen is optional as discussed above. However, it is preferable to rotate it at approximately $(20 \sim 40)/\sqrt{D}$ r.p.m. (D is an inner diameter of the screen measured in meters). At the speed determined by the above criterion, the waste does not tend to adhere to the inner surface of the screen because of centrifugal force, and also the waste does not accumulate at the lower portion of the cylindrical screen 40; rather, the municipal waste will be in a state in between adhesion and accumulation and is subjected to active tumbling effect whereby the waste is advanced toward the discharge opening of the weir 52 under the urging axial force caused by the succeeding waste charged into the hopper 38 and pushed by the feeding blades 47. When the amount of the waste fed toward the discharge opening of the weir 52 and accumulated thereat exceeds a certain value, it overflows the weir and is discharged through the exhaust port 46.

By the provision of the weir 52, a constant amount of the municipal waste is maintained within the cylindrical screen 40 and also the residence or staying time of the waste in the pulverizer is maintained substantially constant. In this case, the staying time "T" may be expressed by the following equation:

$$T = (A.\ L.\ \phi)/Q \qquad (1)$$

wherein

*A:* effective cross sectional area ($m^2$) of the cylindrical screen calculated by subtracting the area obtained by summing the cross-sectional area of all the elements appearing in the cross-sectional view from the area defined by the cross-section of the cylindrical screen;

*L:* effective axial length (m) of the cylindrical screen;

$\phi$: filling ratio of the waste in the cylindrical screen, i.e., the ratio of the volume of the waste within the screen to the effective volume of the screen;

*A. L.* $\phi$: amount ($m^3$) of the waste staying within the cylindrical screen;

*Q:* amount ($m^3$/h) of the waste supply.

Figure 6:
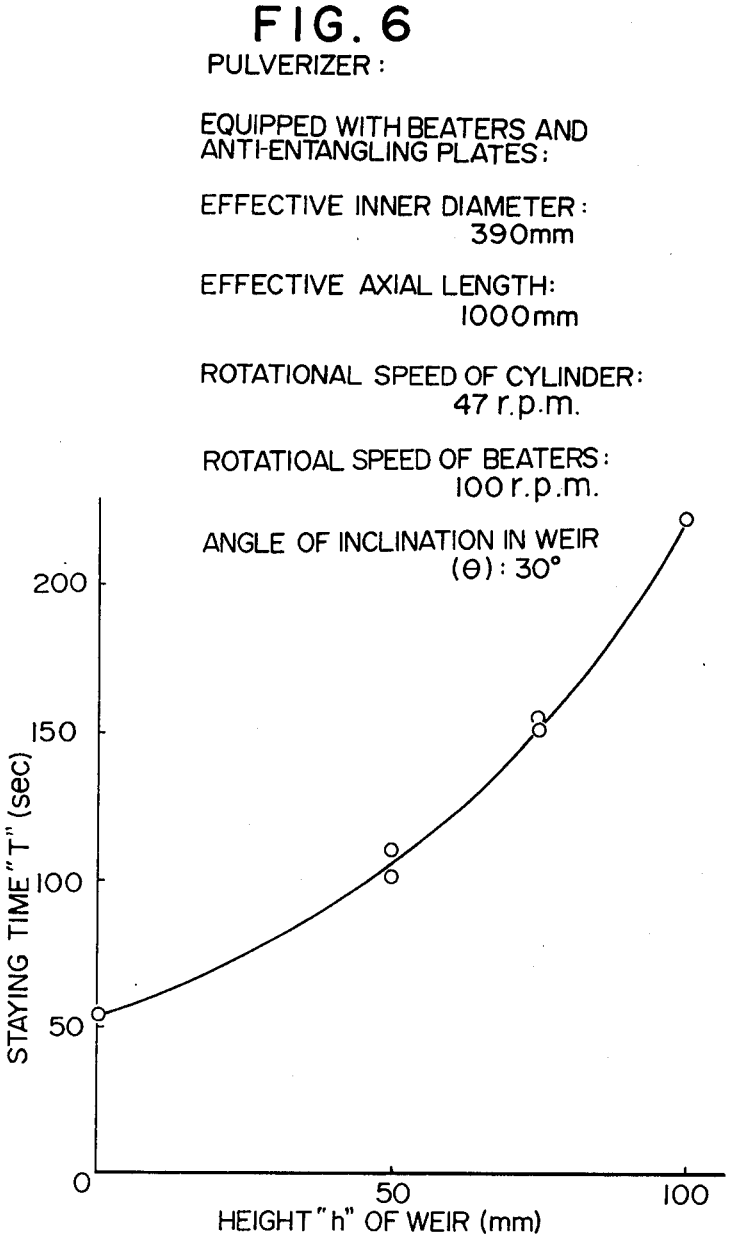
FIG. 6 is a graph illustrating the effect on the residence or staying time "T" of the waste in the pulverizer relative to the height of the weir used in the pulverizer of the present invention.

The desired staying time "T" may be easily attained by selecting the proper height "*h*" of the weir 52 so as to adjust the amount of the waste staying within the cylindrical screen 40. In FIG. 6, the relationship between "*h*" and "T" is illustrated by the graph. This is the test results of the pulverizer equipped with such a weir as illustrated in FIG. 1 which is partially frusto-conical in shape. It is noted from this graph that the staying time "T" is effectively controlled by varying the value of "*h*".

Figure 7:
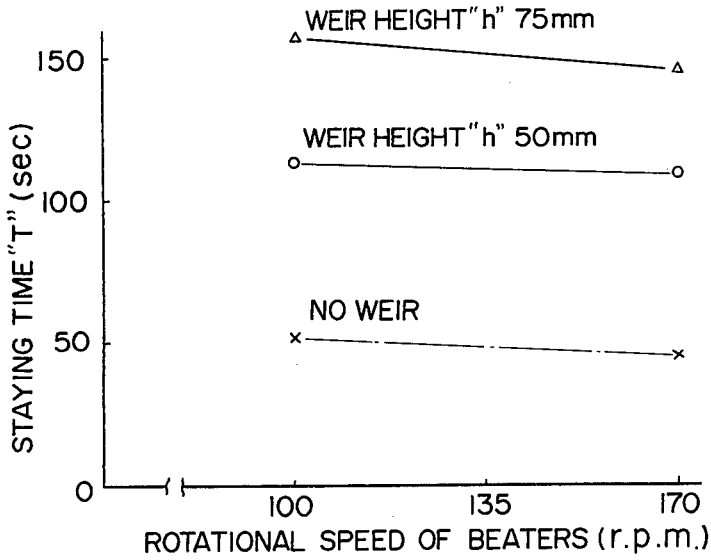
FIG. 7 is also a graph explaining the effect of the height of the weir in relation to the rotational speed of the beaters.

In FIG. 7, other data are presented to show the relationship between the staying time "T" and the rotational speed of the shaft together with beaters to compare the difference in effect between cases wherein weirs are changed and also the case wherein no weir is utilized. From FIG. 7, it is noted that the staying time "T" is not substantially affected by the change of rotational speed if the same weir is utilized. Therefore, the height "*h*" of the weir is considered to be a primary factor in the embodiment illustrated in FIG. 1 for controlling the residence or staying time and, even if the rotational speed is varied depending on the constituents of the waste, the staying time will be substantially the same for the same weir thereby facilitating effective pulverization and sorting of the waste and producing recovered materials in desired state in uniformity and/or separation. The data shown in FIGS. 6 and 7 were obtained by employing a mixture prepared to resemble the composition reported by Tokyo Municipal Office in 1972 and contains the constituents noted in Table I below.

Table I

| | |
|---|---|
| Combustible Constituents | |
| Waste Paper | 38.2% |
| Plastics | 7.3% |
| Fibrous Material (cloth) | 3.6% |
| Wood & Bamboo | 4.2% |

Table I-continued

| | |
|---|---|
| Rubber & Leather | 0.5% |
| Garbage (food waste) | 22.7% |
| Others | 5.7% |
| Sub-Total: | 82.2% |
| Non-Combustible Constituents | |
| Metallic | 4.1% |
| Glass & Ceramic | 7.1% |
| Others | 6.6% |
| Sub-Total: | 17.8% |

The effect of the pulverization and sorting of the waste also depends on the physical properties of the constituents and thus the effectiveness of the process is a function of how long a time the constituents receive the mechanical force applied by the rotation of the cylindrical screen and the beaters. In other words, constituents with relatively little resistance to mechanical impact or shreading will be pulverized and passed through the perforations of the screen earlier than the constituents with relatively high resistance to those mechanical forces referred to above. Therefore, the pulverized constituents may be different axially and therefore segregation or sorting is accomplished by removing the pulverized constituents at different axial points or portions. This consideration leads to a construction suitable for removing the pulverized constituents at different places. For instance, in FIG. 1, the number of discharge ports such as the port 42 may be increased along the axis of the pulverizing section.

Also, it is preferable to provide a plurality of cylindrical screens axially with each other which may give versatility to change the mesh size of the screen (diameter of the perforations) or the relative speed between the screens. Also, it may be advisable to divide the shaft into a plurality of sections so that the rotational speed of the beaters may be optionally changed to meet the variations in the screens and the composition of the waste.

Figure 8:
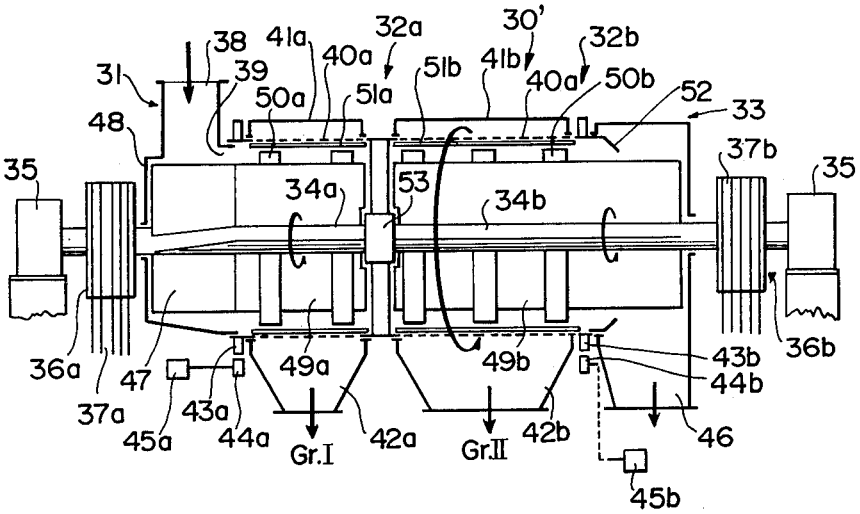
FIG. 8 is another embodiment of the present invention wherein the screen and the shaft are divided into two parts, respectively.

A second preferred embodiment is shown in FIG. 8 wherein a pulverizer 30' similar to that shown in FIG. 1 is illustrated. This pulverizer 30' comprises two pulverizing sections, namely a first section 32*a* and a second section 32*b* and also two shafts, namely a first shaft 34*a* and a second shaft 34*b* which were discussed in the preceding paragraph. In this embodiment, the portions whose functions are the same as those in the embodiment of FIG. 1 are assigned the same reference numbers as those assigned in FIG. 1 and the portions similar to those in FIG. 1 are assigned the same reference numbers as those in FIG. 1 except with addition of suffixes "*a*" and "*b*." These suffixes "*a*" and "*b*" are used to indicate those parts or elements corresponding to the first pulverizing section 32*a* and the second pulverizing section 32*b*, respectively. The respective functions of those elements are the same as those without such a suffix in FIG. 1. It will be readily understood that the discharge ports 42*a* and 42*b* facilitate the segregation or sorting of the pulverized waste. At the connecting point of the shafts 34*a* and 34*b*, a journal bearing 53 is provided so as to rotatably support the opposite shafts respectively and to allow relative rotation therebetween. The detailed construction of the bearing 53 may not be necessary to those skilled in the art. By the provision of independent driving means to the respective screens 40*a*, 40*b* and shafts 34*a*, 34*b*, those rotating portions are able to be driven independently so as to provide versatility in determining operating factors.

As touched upon earlier, if the capacity of the pulverizer is small, there will be no problem with the deflection of the shaft which is normally suspended at opposite ends by a suitable bearing means. However, in order to meet the recent demands for treating huge volumes of waste and recovering as much of the constituents as possible for re-use, it is necessary to make the size larger and/or axial length of the pulverizer longer. This trend also necessitates making the diameter of the shaft large and also the respective weight of the various elements concerned become greater and greater. On these occasions, the shaft may tend to deflect due to the weight of the shaft and the elements associated therewith. The deflection of the shaft may cause difficulty in maintaining the clearance "*c*" between the tips of beaters and the inside surface of the screen or the ridge projections and sometimes may cause interference therebetween.

Also, as explained in the embodiment of FIG. 8, it has been proposed to employ a plurality of shafts rather than a single shaft, particularly when a plurality of cylindrical screens are employed. To rotatably support such a plurality of shafts, it was also proposed to support one end of the shaft which is inside of the screen by the opposing end of the other shaft which is made at least partially hollow to journally receive the one end of the shaft first mentioned therein. (The detailed description of such construction may be found in U.S. Pat. No. 3,491,689 issued on Mar. 2, 1976.) In this case, the deflection will be a problem, and it would be necessary to employ a shaft having a large diameter which results in increased weight.

In the embodiment of FIG. 8, the same problem with regard to deflection will occur, depending on the length of the shafts. To prevent this deflection, braces or stays may be used to support the journal bearing 53. However, these braces or stays may interfere with the waste advanced by the rotation of feeding blades 47, so these stays are generally made as small as possible to reduce the interference and also the number of stays is kept to a minimum. On the other hand, as explained in connection with the embodiments above, the feeding or advancing of the waste is effected only by the feeding blades 47 mounted on the shaft below the hopper and thus, even though the dimensions and number of the stays are considered, the waste advanced by the feeding blades 47 may dwell between the beaters near the end opening of the cylindrical screen 40*a* and the braces or stays and sometimes may cause blocking of the passages between the two screens 40*a* and 40*b*. As previously explained, it is not advisable to provide advancing effect on the elements such as the beaters and/or anti-entangling plates by applying twist or inclination thereto, since these elements with added functions for advancement may affect the staying time "T" in the pulverizer. An embodiment of the above, a pulverizer 130, is illustrated in FIGS. 9 through 13. In that illustrated embodiment, elements having the same function as those in the embodiment of FIG. 8 are assigned the same reference numbers as those in FIG. 8 with addition of "100" thereto, respectively and the detailed explanation therefore will be omitted. Thus, reference is to be made to the foregoing explanation for those elements not specifically explained.

Figure 10:
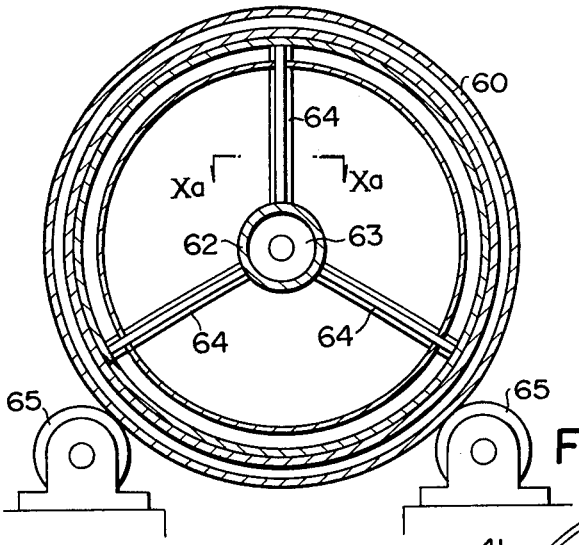
FIG. 10 is a cross-section of the spider assembly of FIG. 9 taken along line X—X.
Figure 9:
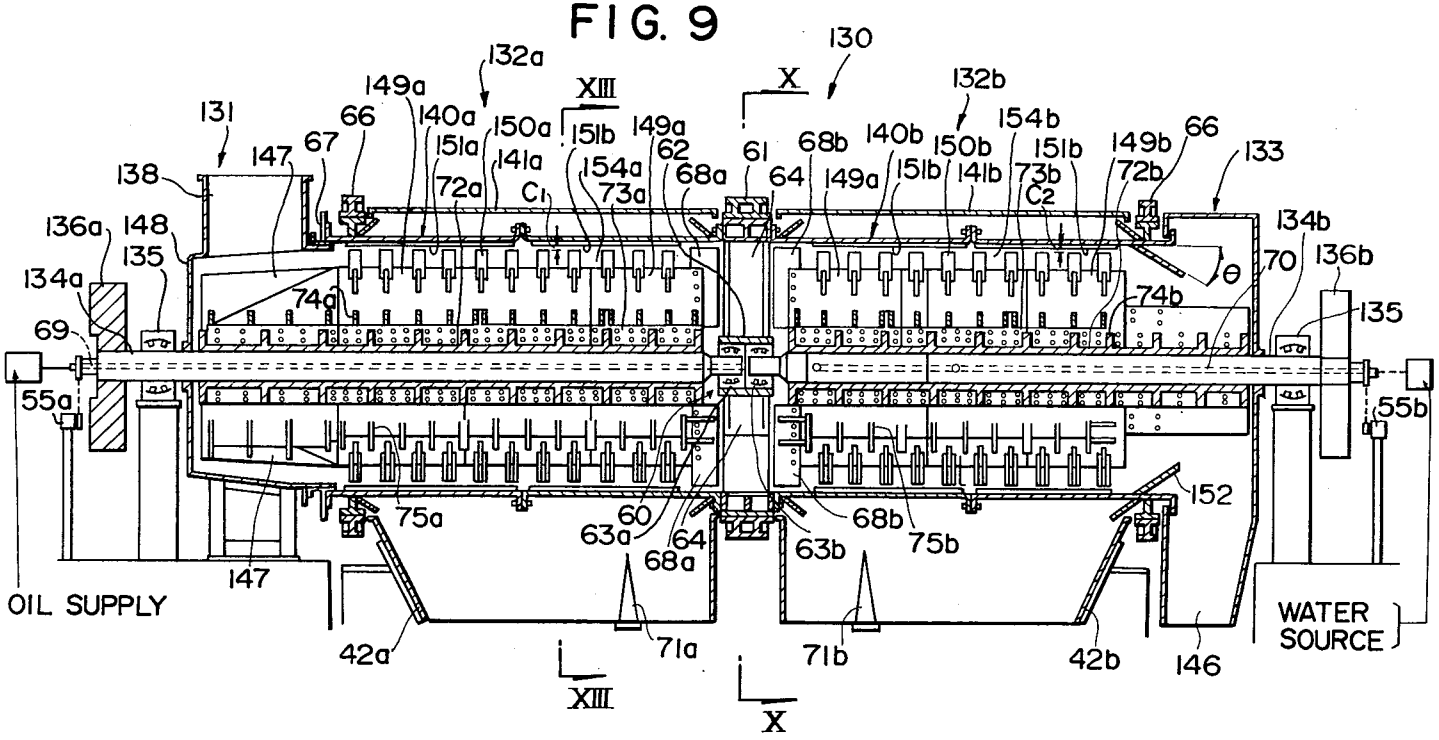
FIG. 9 is still another embodiment, similar to that of FIG. 8 but equipped with a means for preventing deflection of the shaft.

Referring to FIG. 9, the pulverizer 130 is of a type similar to that of the pulverizer 30' shown in FIG. 8 and comprises two staged pulverizing sections 132*a* and 132*b*. At the coupling point of the two shafts 134*a* and 134*b*, there is a spider assembly 60 comprising a guide ring subassembly 61, a bearing hub 62, housing roller bearings 63*a* and 63*b*, and stays 64 extending from the inner periphery of the guide ring 61 towards the axis of the shaft to centrally support the hub 62. The bearings 63*a* and 63*b* are preferably self-aligning bearings; however, this is not mandatory. The respective ends of the shafts 134*a* and 134*b* opposite both end bearings 135 are received within inner races of the bearings 63*a*, 63*b*. The spider assembly is rotatably supported by rollers 65 as shown in FIG. 10, the rollers 65 being rotatably supported on the ground or base. At the portions near the opposite ends of the pulverizer 130, guide rings 66 are mounted on the outside of cylindrical screens 140*a* and 140*b* which are also rotatably supported by the rollers similar to rollers 65. These rotatable supporting means are also applicable to the embodiments of FIG. 1 or FIG. 8. The respective ends of the cylindrical screens 140*a* and 140*b* adjacent to the spider assembly 60 are coaxially connected to the spider assembly so that the two screens 140*a* and 140*b* are rotated together. Also, at one end of the screens 140*a* or 140*b*, a ring sprocket 67 is mounted on the outside of the cylindrical screen. (In FIG. 9, the sprocket is mounted on the screen 140*a*.) This sprocket 67 is coupled with a driving source (not shown) through a chain (also not shown) for rotating the screens. Although the sprocket 67 is illustrated in FIG. 9, a driving means similar to the combination of the ring gear 43 and the pinion 44 may be utilized instead.

Figure 10A:
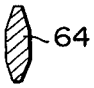
FIG. 10*a* is a cross-section of a stay or brace of the spider assembly shown in FIG. 10 and taken along line X*a*—X*a;*
Figure 11:
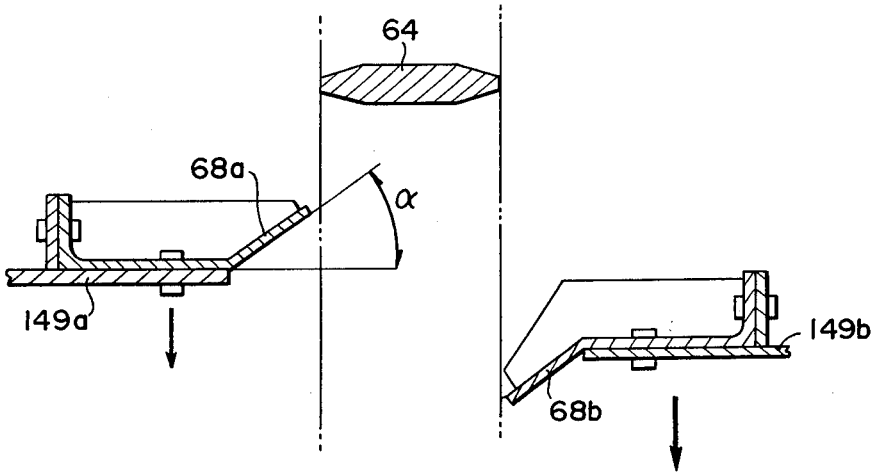
FIGS. 11 and 12 are illustrations showing the relationship of part of the spider assembly and the downstream end of the first part shaft and the upstream end of the second part shaft, respectively.
Figure 12:
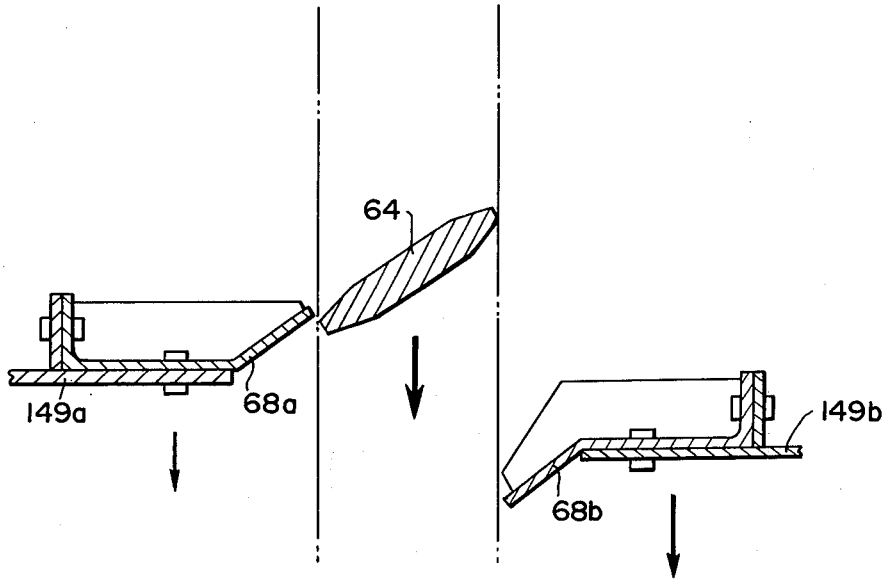

At the respective downstream ends of the anti-entangling plates 149*a*, auxiliary feeding blades 68*a* are attached with inclination relative to the axis of the shafts so that the waste tending to dwell in front of the stays 64 of the spider assembly 60 is urged to pass the spider assembly into the cylindrical screen 140*b*. To further assist the advancement of the waste, auxiliary feeding blades 68*b* may be affixed at the respective up-stream ends of anti-entangling plates 149*b*. The cross sectional configuration of the stays 64 is preferably determined so as to minimize the resistance to the feed of the waste passing through the spider assembly 60. An example of such configuration is illustrated in FIG. 10*a*. Also the relationship of the elements adjacent to the stays is shown in FIG. 11 wherein it is observed that the auxiliary feeding blades 68*a* and 68*b* extend, respectively closely to the stays 64. The inclination "$\alpha$" of the auxiliary blades is preferably within the range of 10° – 35°. When the spider assembly 60 is rotatable as explained, it is preferable to give inclination to the stays 64, as illustrated in FIG. 12, which may also serve to advance the waste.

In order to lubricate the roller bearings 63*a* and 63*b*, an oil passage 69 is provided in the shaft 134*a*. Also, there is illustrated a liquid passage 70 which is used to spray water on the waste. To such end, a suitable number of openings are provided at approximate axial positions along the shaft 134*b* so as to extend radially through the shaft from the water passage 70 to the surface of the shaft. Spraying water on the waste is particularly useful in recovering waste paper as crude pulp stock by wetting the waste paper to weaken it so as to be easily pulverized. Disposed at the respective opposite ends of the shafts 134*a*, 134*b* are tachometers 55*a* and 55*b* to monitor the rotational speed of the shafts 134*a* and 134*b*, respectively.

Although it has been explained that the two cylindrical screens 140*a* and 140*b* of the pulverizer 130 are integrally coupled by the spider assembly 60, either one of the screens 140*a* or 140*b* may be disconnected from the spider assembly 60 so that either of the two screens 140*a* and 140*b* may be independently driven by providing an additional driving means. Such disconnection may be easily accomplished by an additional support means rotatably supporting the disconnected end of the screen which might take the form of a combination of a guide ring and supporting rollers.

By operating the pulverizers 30, 30' and 130, the municipal waste is pulverized. As a typical example, such operation will be explained with respect to the pulverizer 30'. For convenience in explanation, the pulverized waste is classified as follows.

Gr. I: constituents having the lowest resistance to shock or impact; this group is comprised mostly of garbage, glass, ceramics and rubbish.

Gr. II: constituents having intermediate resistance to impact and shear; this group is comprised mostly of waste paper.

Gr. III: Constituents having the greatest resistance to impact and shear; this group may be further divided into two groups namely Gr. III*a* and Gr. III*b*.

Gr. III*a* is made up of metallic constituents and

Gr. III*b* is made up of other remaining constituents such as plastics, fibrous waste cloth, chips of wood, rubber and leather, etc.

The pulverizer 30' effectively treats the municipal waste which comprises the constituents corresponding to Gr. I, Gr. II and Gr. III. When the waste is charged into the hopper 31, constituents belonging to Gr. I are at first selectively pulverized by the shearing and beating effect applied to the waste by the ridge projections and beaters and the mixing and agitating effect given by the bottles and cans possibly contained within the waste. Thus, the pulverized waste belonging to Gr. I selectively passes through the screen 40*a* into the space between the screen and casing 41*a* and is discharged outwardly from the discharge port 42*a*. The remaining constituents belonging to Gr. II and Gr. III are generally advanced into the screen 40*b*. Most of the garbage originally accompanying waste paper contained in Gr. II is segregated as Gr. I and discharged, so it is convenient to recover waste paper as crude pulp stock from the remaining Gr. II and Gr. III constituents. Within the cylindrical screen 40*b*, the constituents of Gr. II are selectively pulverized and discharged through the discharge port 42*b*. If the constituents of Gr. II mainly consist of waste paper, wetting the waste paper by spraying water by such means as water passage 70 and radially perforated openings in the shaft 134*b* illustrated in FIG. 9, serves to weaken the waste paper so as to facilitate the pulverization thereof and recovery of it as the crude pulp stock. As to the spraying function, coupling (not shown) may be provided between the water supply source and the water passage 70 so that water spraying may be limited when a certain quadrant in the section of the shaft 134*b* passes a certain point, spraying in effect may be further controlled.

Constituents belonging to Gr. III are discharged lastly through the exhaust port 46.

Hereinafter, some operational factors suitable or preferable for the pulverizers of the present invention will be presented. The preferred equivalent diameter of the screen perforations and preferred rotational speed of the screen, which are applicable to all the embodiments explained above, have already been touched upon. The beaters and the cylindrical screens are naturally driven so as to produce relative speed therebetween so that the pulverizing effect may be enhanced. For example, within the first stage that is in the cylindrical screen 40*a* of the pulverizer 30', the relative speed between the tips of the beaters 50*a* and the ridge projections 51*a* is most preferably in the range of 1 – 3 m/sec. If a value lower than the above is selected, the garbage and other constituents belonging to Gr. I will not be completely pulverized and will pass into Gr. II and if a value outside the upper limit of the range above is selected, the waste paper or the like will be pulverized and discharged in the first stage and, thus, the recovery rate of the crude pulp stock becomes lower.

Regarding the relative rotational speed of the screen 40*b* in the two stage pulverizer 30', the range of 3 – 6 m/sec. is preferable. If a value lower than the above is selected, the waste paper is not pulverized enough and some portion thereof is transported and mixed with Gr. III; if a value higher than the upper limit of the range above is selected, some part of Gr. III is pulverized and discharged through the discharge port 42*b*.

Also, as touched upon earlier, the composition of the municipal waste often varies. Therefore, a certain operational condition which may be satisfactory for one composition may not be satisfactory when the characteristic features and composition of the waste are different. For example, an increase or decrease in the moisture content of the waste, particularly with respect to the waste paper contained therein, will require adjustment of the operational factors. Therefore, the operational factors are preferably adjusted taking into consideration the characteristics of each batch of waste. Also, considering the degree of progress of pulverization which is also a function of the axial direction, separators are provided in the discharge ports to axially separate the ports. Referring to FIG. 9 again, such separators 71*a* and 71*b* are provided in the discharge ports 42*a* and 42*b*, respectively. These separators are adapted to axially separate the pulverized constituents so that the reusable constituents are further effectively segregated and recovered. Also, it is preferable to make the separators 71*a* and 71*b* movable or adjustable in the axial direction so as to be adaptable to variation in the composition of the municipal waste. This may be achieved by making them axially slidable or swingable.

In the embodiment illustrated in FIG. 9, the clearances between the tips of beaters and the ridge projections are identified as "$c_1$" within the first stage screen 140*a* and as "$c_2$" within the second stage screen 140*b*. These clearances may be the same; however, it is preferable to determine the relationship between the mesh size and the clearance by the following formula, i.e.

$$c_1 > c_2;$$

and especially, $$c_1 > 0.7d > c_2$$

In case of the pulverizer 130, if the residence or staying time of the waste in the first stage screen 140*a* is assumed to be 1.5 minutes, approximately 93% of the garbage is discharged under the relationship above. Within the above residence or staying time, approximately 30% of the waste paper is pulverized and admixed with the above discharged garbage. If the relationship is set to be $c_1 = c_2 < 0.7d$, 93% of the garbage will be discharged within 1 minute; however, during this period, approximately 53% of the waste paper is also discharged together with the garbage thereby reducing the recovery rate of the crude pulp stock obtained in the second stage. Also, if the relationship $c_1 = c_2 > 0.7d$ is established, the pulverizing efficiency in the second stage is reduced. Therefore, the relationship set forth above, i.e.

$$c_1 > 0.7d > c_2$$

is the preferred value.

Figure 13:
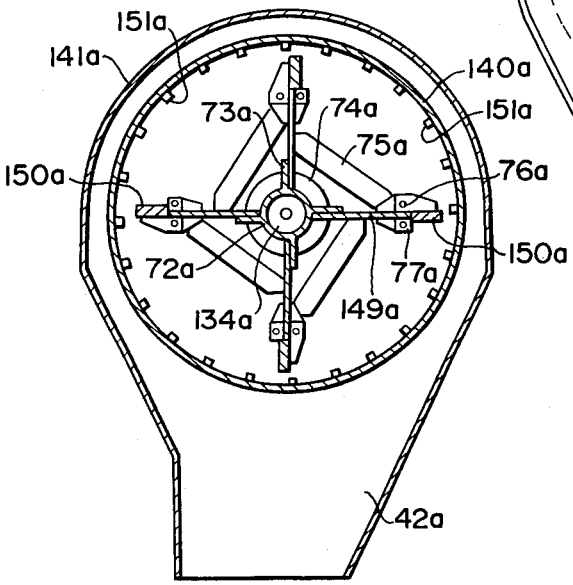
FIG. 13 is a cross-section of the pulverizer of FIG. 9 taken along line XIII—XIII.

In order to illustrate another feature of the present invention, a section of the pulverizer 130 (FIG. 9) is illustrated in FIG. 13. As seen in FIGS. 9 and 13, hollow pipes 72*a* and 72*b* are fitted on the shafts 134*a* and 134*b*, respectively. These hollow pipes are provided with radial fins 73*a*, 73*b* which are designed to have mounted thereon the anti-entangling plates 149*a* and 149*b* by means of suitable fastening means such as bolts, rivets or welding. Also, in the axial direction of the shafts 134*a* and 134*b*, there are a plurality of ring shaped ribs 74*a* and 74*b* on the pipes 72*a* and 72*b*. The construction of the shaft and the pipes having the fins and ribs above makes fabrication of the shafts and elements connected thereto easy. The fins 73*a*, 73*b* and the ribs 74*a*, 74*b* may be welded to the pipes 72*a*, 72*b*. After completion of the welding, the anti-entangling plates 149*a*, 149*b* may be secured to the sleeves.

Figure 14:
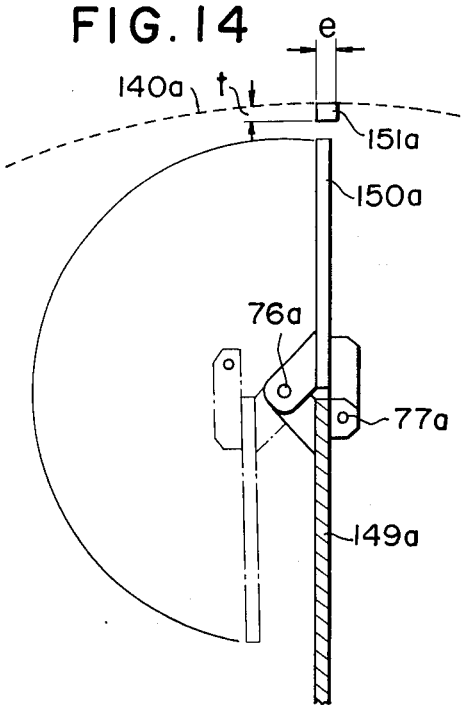
FIGS. 14 and 15 illustrate the pivotable mechanism of the beaters associated with shear pins.
Figure 15:
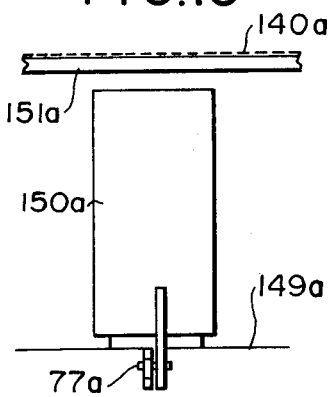

Braces 75*a*, 75*b* may be provided to reinforce the elements concerned. As shown in FIG. 13, the braces 75*a* are welded at the portion remote from the shaft to the adjacent anti-entangling plates 149*a* so as to minimize the distortion of the shaft due to heat by the welding operation. These braces may also be attached by a mechanical fastening means such as bolts or rivets. Referring to FIGS. 13, 14 and 15, at the radial end edges of the respective anti-entangling plates 149*a*, 149*b*, beaters 150*a* and 150*b* are mounted by pivot pins 76*a*, 76*b* and shear pins 77*a*, 77*b*. Since each beater 150*a* or 150*b* is mounted by two pins (76*a*, 77*a*) or (76*b*, 77*b*), each beater is fixed relative to the anti-entangling plate 149*a* or 149*b*. The passages 54 defined by the anti-entangling plates, beaters and ridge projections are discussed in connection with FIG. 1. The preferable dimension referred to at that time are also applicable to the pulverizer 130 wherein the passages are assigned references 154*a* and 154*b*. The dimensions as discussed above are generally satisfactory to pass therethrough the constituents which would not be pulverized by the agitating and mixing effect applied to such certain constituents. However, should a larger item having strength resistant to the effect of the pulverizer exist in the waste, it might damage the pulverizer and even cause shutdown of the operation. For instance, if the waste contains a thick and large steel plate, it may cause jamming at the passages 152*a*, 152*b* and also damage the elements attached thereto. On such an occasion, if the strength of the shear pins 77*a*, 77*b* is selected so as to be sheared by the interaction between the item and the beaters while the pins 76*a* or 76*b* withstand such interaction. If some of the shear pins are sheared as above, the concerned beaters 150*a* or 150*b* pivot to make the space of the passages 152*a* or 152*b* larger so that such item may easily pass through the enlarged passages. In FIG. 14, the possible movement of the beater upon shearing of the shear pin is illustrated in chained lines. The provision of the shear pins, thus, contributes to maintaining the pulverizing operation without shutdown and avoids critical damage of the apparatus. Also, by mounting the beaters 150*a*, 150*b* by means of pins 76*a*, 76*b*, 77*a*, 77*b*, it is easy to remove the beaters for replacing the same or to effect padding of the material on the worn tips thereof for reuse. Therefore, the provision illustrated in FIGS. 14 and 15 is also very advantageous in the maintenance of the apparatus.

Also, it is preferable for easy maintenance to make the ridge projections 151*a*, 151*b* removable or replaceable by employing a mechanical fastening means such as bolts.

Now, the preferable dimensions of the ridge projections are briefly touched upon. The inventors found that if the equivalent diameter of the perforation of the screen is "*d*," the height "*t*" and the width "*e*" of the ridge projections 151*a* and 151*b* are preferably in the following ranges for attaining effective pulverization and sieving.

$$e \leqq d;$$

and $$t \leqq d$$

The dimension of "*d*" is also the same as before. (i.e. 20 – 45 mm). If the height "*t*" is too great, the force applied on the waste between the beaters and the ridge projections may exceed the preferable limit so that the shear pins 77*a*, 77*b* are often broken or the motor driving the pulverizer may receive a shock load. Either of these may result in shutdown of the pulverizer and reduction in efficiency, of the operation. However, if the relationship noted above ($t \leqq d$) is satisfied, the breaking force induced by the ridge projections may become less than the shear strength of the shear pins and, thus, frequent breakage of shear pins can be prevented. The shear strength of the shear pins is preferably determined by considering the torque of the motor employed.

In the foregoing explanation, the effect of the frusto-conical weirs 52 and 152 is the same in all of the embodiments. That is, these weirs effectively serve to control the quantity of the waste and the staying time of the waste in the pulverizer to achieve the most efficient pulverization and segregation.

In all of the foregoing embodiments, the frusto-conical weirs are replaceable, so the height "*h*" of the weirs can be changed. The effect of variation in the height has been previously explained with respect to FIGS. 6 and 7.

Figure 16:
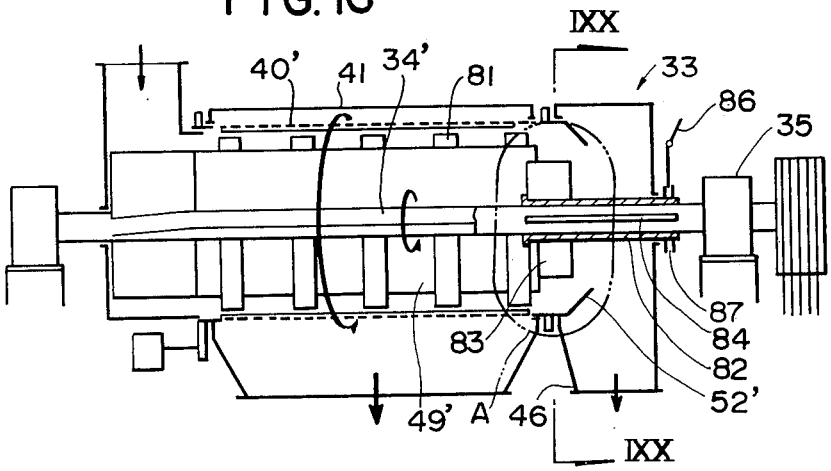
FIG. 16 is still another embodiment of the present invention incorporating a mechanism for altering the degree of restriction at the outlet opening of the cylindrical screen.
Figure 17:
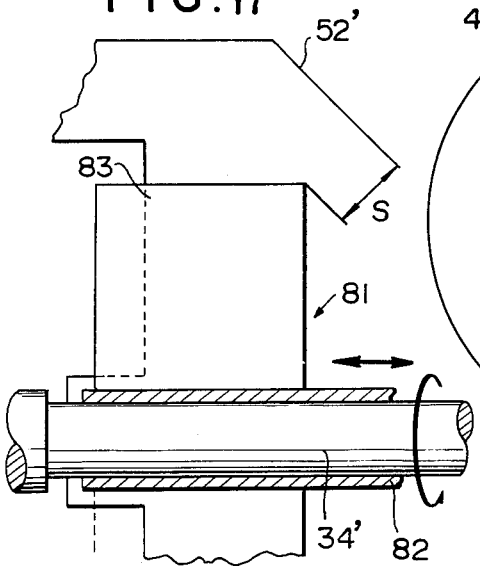
FIG. 17 is a fragmental illustration of the portion marked "A" in FIG. 17.
Figure 18:
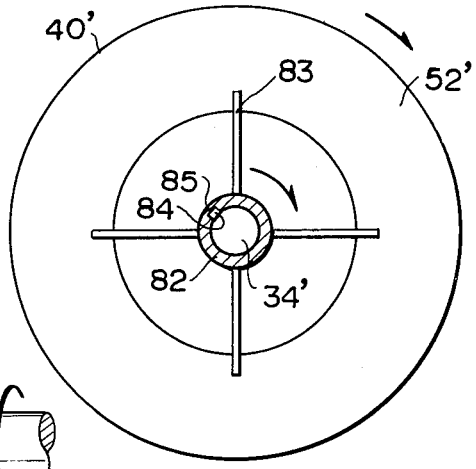
FIG. 18 is a cross-section taken along line IXX—IXX in FIG. 16.

FIGS. 16, 17 and 18 show another embodiment for controlling the area of the discharge end of the cylindrical screen 40. (The reference numerals employed here to identify the elements correspond respectively to those used in FIG. 1.) At the discharge end of the screen 40', there is attached a frusto-conically shaped weir 52' similar to the weir 52 shown in FIG. 1. Also neighboring the weir 52' and on shaft 34', a blade assembly 81 is slidably mounted so as to be axially displaceable. Consequently, the axial length of the anti-entangling plates 49' is relatively short compared to that of the plates 49 shown in FIG. 1 in order to provide space for the blade assembly 81. The blade assembly 81 comprises a sleeve or slider 82 slidably disposed on the shaft 34, and blades 83 radially mounted on the slider. In order to rotate the blade assembly 81 with the shaft 34, there is provided an axial key 84 on the shaft and, on the other hand, a slot 85 slidably receiving the key 84 is provided in the sleeve. By the combination of the key 84 and slot 85, the blade assembly 81 may be shifted in the axial direction as indicated by an arrow in FIGS. 16 and 17 while keeping the rotational relationship with the shaft 34'. Instead of the combination of the key and slot, a spline shaft and a splined hole may be utilized. The gap "S" indicated in FIG. 17 between the blades 83 and the frusto-conical weirs 52' is easily varied by displacing the assembly 81 in the axial direction. A lever 86 is provided so that one end of the lever is received in a circular groove provided in the slider 82 by which the slider 82 may be displaced axially through the lever 86 during the rotation of the blade assembly 81. The resulting effect is similar to that obtained by changing the height of the weirs.

By varying the value of "S", it is possible to increase or decrease the quantity of municipal waste staying within the pulverizer which may be expressed by $$V = A\,L\,\phi \qquad (2)$$

wherein the references are the same as those in the equation (1) except for V which is the quantity of the waste held within the cylindrical screen measured in ($m^3$).

In a drum type pulverizer or fermenting device, it is acknowledged that the quality of produced articles may be maintained regardless of change in value $\phi$ above if the residence or staying time of the object mixture to be treated is maintained constant. Therefore, the provision explained in FIGS. 16, 17 and 18 makes it possible to vary the quantity of the waste to be treated while maintaining the quality of the product.

Figure 19:
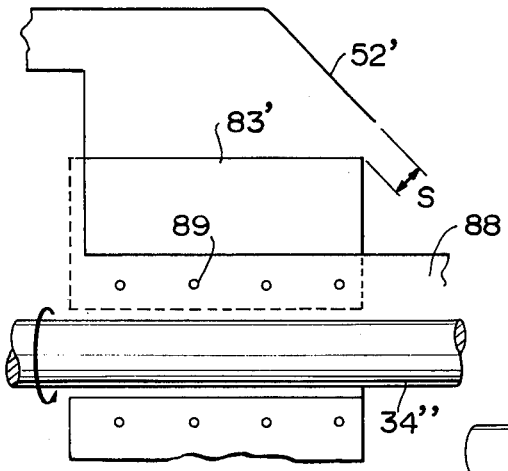
FIGS. 19 and 20 show a modification of the part similar to that shown in FIG. 17.

If it is not necessary to alter the gap "S" during the operation, the construction illustrated in FIG. 19 is used. In this case, blades 83' are attached to ribs 88 on the shaft 34'' by means of mechanical fastening means such as bolts 89, and the gap "S" is adjusted by replacing the blades 83'.

Figure 20:
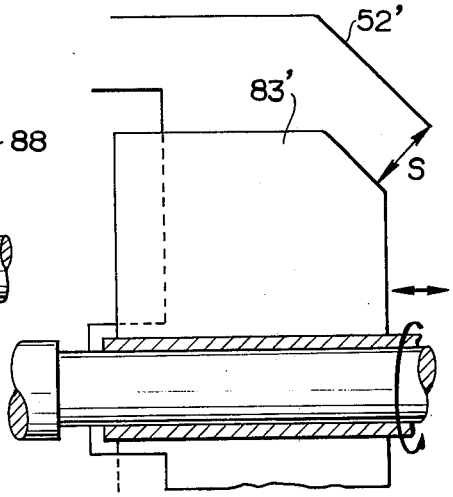

Also, in FIG. 20, one example of a modification in the shape of the blade is illustrated as "83" one edge thereof being parallel to the frusto-conical surface. The shape of the blades, however is not limited to those illustrated.

Figure 21:
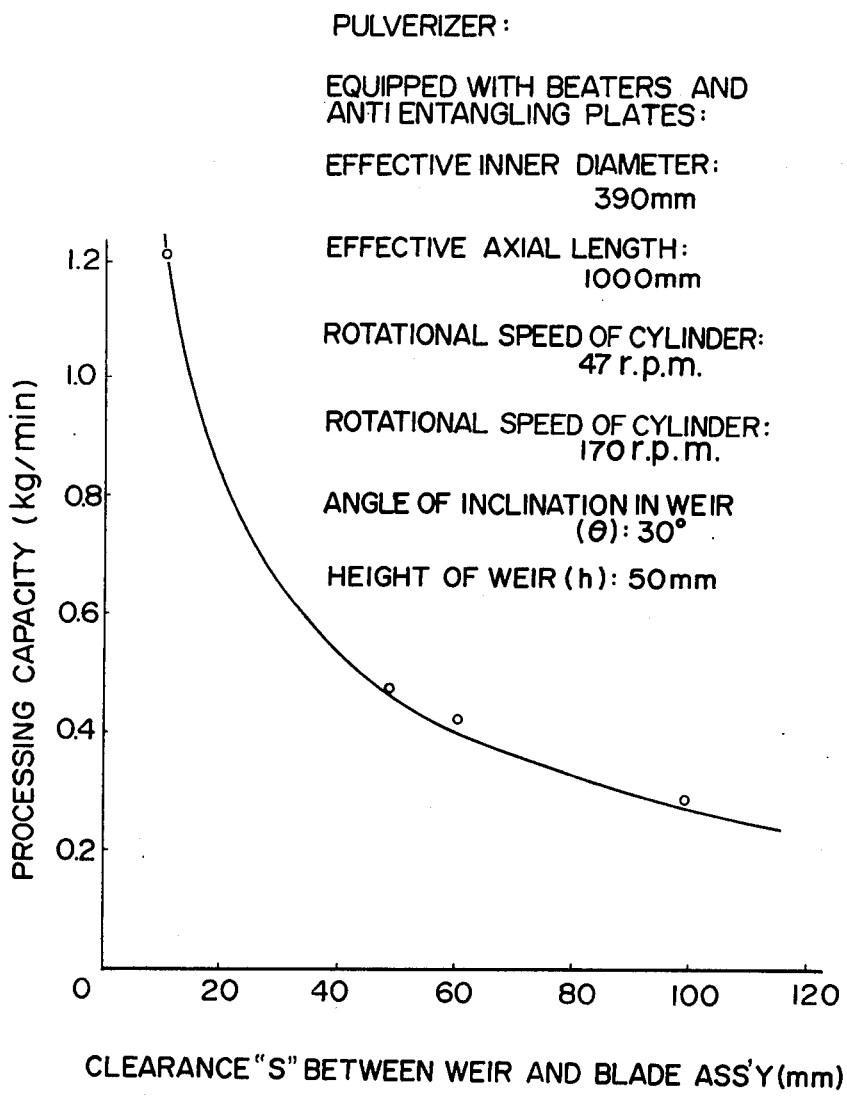
FIG. 21 shows the effect of variation in degree of restriction at the place of the weir.

In FIG. 21, the effect of the change in clearance or gap "S" relative to the quantity of the waste treated is illustrated. In this test, the same mixture shown in Table I was employed.

From the foregoing explanation, it is clear that the staying time or residence time of the waste is suitably controlled to obtain optimum result by a pulverizer of simplified construction which can be manufactured, installed and maintained at lower cost.

Also, the invention has been explained by using as an example the treating of municipal waste. However, the method and apparatus of the present invention are applicable to other fields as already touched upon.

The invention has been explained in detail referring to the embodiments thereof; however, the invention is not limited to those explained and modifications and variations thereof are, of course, available to those skilled in the art within the spirit and scope of the present invention claimed.

What is claimed is:

1. A drum-type pulverizer for pulverizing a mixture of materials, said pulverizer comprising:

a rotatable cylindrical screen having a plurality of ridge projections on the inside surface thereof and having inlet opening and outlet openings;

a rotatable shaft centrally and coaxially extending through said cylindrical screen;

a plurality of anti-entangling plates, each radially mounted on said shaft;

feed means at said inlet opening for advancing the material to be pulverized from said inlet opening toward said outlet opening;

a frusto-conical shaped weir attached at the outlet opening of said cylindrical screen restricting the area of said opening;

a plurality of beaters, each beater being radially mounted on the edge of one of said anti-entangling plates;

at least one pin member pivotally connecting at least one of said beaters to said anti-entangling plate associated therewith; and breakable support means further connecting said pivotally connected beater and said anti-entangling plate, said breakable support means being weaker than said pin member, for supporting said beater in a radially projecting direction on said anti-entangling plate and for breaking under pressure and allowing said beater to pivot about said pin member toward said anti-entangling plate.

2. A pulverizer as claimed, in claim 1 further comprising a blade assembly within said cylindrical screen adjacent said weir on the shaft and axially slidable along the axis of said shaft while it is rotated with said shaft, whereby the degree of restriction at said opening is varied.

3. A pulverizer as claimed in claim 1 wherein said breakable support means are shear pins.

4. A pulverizer as claimed in claim 1, further comprising:

a circular casing at said inlet opening of said cylindrical screen, said casing being co-axially aligned with said rotatable shaft;

hopper means above and connected to said circular casing in an off-set relationship with respect to said central axis of said circular casing for charging said mixture to be pulverized into said circular casing along the circumference thereof; and wherein said feed means is comprised of a plurality of feeding blades mounted on said shaft within said circular casing off-set below said hopper, each blade having an inclination with respect to the axis of said shaft so that the mixture charged through said hopper into said casing is advanced toward said outlet opening upon rotation of said shaft, said blades extending in the direction away from said outlet opening beyond the passage of said object mixture charged into said hopper and casing.

5. A pulverizer as claimed in claim 4 wherein said casing is constructed to provide a clearance gradually incresing from upstream to downstream with respect to the feeding direction between the same and said feeding blades.

6. A pulverizer as claimed in claim 4 wherein:

said cylindrical screen is comprised of a first part and a second part coaxially aligned and a spider assembly coupling said first and second parts;

said shaft is comprised of a journal bearing within said spider assembly and a first shaft part and a second shaft part, each shaft part having respective beaters and anti-entangling plates thereon and coupled to each other through said journal bearing;

said spider assembly is comprised of an outer guide ring rotatably supported by rolling means and a plurality of stays connecting said outer guide ring and said bearing to support said bearing in place, said stays having an inclination with respect to the axis of the spider, thereby enhancing, upon rotation thereof, the advancement of the materials passing through the spaces between the stays; and said feed means is further comprised of:

in addition to said plurality of blades below the hopper, first auxiliary feed blades mounted on the first part shaft adjacent the spider assembly and within the downstream end of the first part screen and second auxiliary feed blades mounted on said second part shaft adjacent the spider assembly and within the upstream end of said second part screen.

7. A pulverizer as claimed in claim 6, wherein a plurality of pivotally connected beaters having said breakable support means connecting said beaters and said anti-entangling plates are provided, at least one pivotally mounted beater in each of said first and second screen parts.

* * * * *